United States Patent [19]

Turk et al.

[11] 4,202,163

[45] May 13, 1980

[54] SPINNING PROCESS AND APPARATUS

[75] Inventors: Herbert Turk, Remscheid; Herbert Schiminski, Huckeswagen; Erich Lenk, Remscheid, all of Fed. Rep. of Germany

[73] Assignee: Barmag Barmer Maschinenfabrik Aktiengesellschaft, Remscheid-Lennep, Fed. Rep. of Germany

[21] Appl. No.: 890,978

[22] Filed: Mar. 28, 1978

[30] Foreign Application Priority Data

Mar. 30, 1977 [DE] Fed. Rep. of Germany ..... 2714089
Jul. 20, 1977 [DE] Fed. Rep. of Germany ..... 2732678

[51] Int. Cl.[2] ..... D01H 1/12

[52] U.S. Cl. ..... 57/58.95; 19/105; 57/327; 57/58.89

[58] Field of Search ..... 57/50, 5, 58.89, 58.95, 57/156, 333, 327; 19/105, 205, 98

[56] References Cited

U.S. PATENT DOCUMENTS

| | | | |
|---|---|---|---|
| 3,411,283 | 11/1968 | Isomura | 57/58.89 |
| 3,626,041 | 12/1971 | Fields | 57/58.89 X |
| 3,913,310 | 10/1975 | Fehrer | 57/58.89 X |
| 3,972,173 | 8/1976 | Fehrer | 57/58.89 |
| 3,981,137 | 9/1976 | Fehrer | 57/156 |
| 4,051,652 | 10/1977 | Mitteregger | 57/58.89 |
| 4,060,966 | 12/1977 | Konig | 57/58.89 |
| 4,067,181 | 1/1978 | Fehrer | 57/58.95 X |
| 4,130,983 | 12/1978 | Dammann et al. | 57/58.95 X |

*Primary Examiner*—John Petrakes
*Attorney, Agent, or Firm*—John H. Shurtleff

[57] ABSTRACT

Process and apparatus for spinning fibers into a yarn in a yarn forming zone in the gap between air permeable surfaces of two rollers or on a single, air permeable roller surface while drawing a current of air adjacent said zone through said surface or surfaces by suction means, a feed channel with a narrow mouth adjacent the yarn forming zone for feeding an air stream and individual, separated fibers therein to the yarn forming zone from a carding roller rotating in a carding chamber to which a sliver or tow of fibers is fed, a casing about the rollers and the mouth of the channel with means for maintaining a desired subatmospheric to superatmospheric pressure in the casing and especially in the free flight interval of the fibers from the channel mouth to the yarn forming zone, a pressurizable casing about the carding unit and at least one air passage from the casing to the carding chamber, and using sequential, cascade-type, pressure decreases in the carding chamber, the feed channel, the free flight interval of the fibers at the yarn producing zone, and the suction means to attain optimum conditions for producing uniform and high strength yarns.

30 Claims, 9 Drawing Figures

SPINNING PROCESS AND APPARATUS

From the British Pat. No. 1,445,360 it is a known practice to spin a yarn from individual fibers, as fibers are fed to a moving surface. This surface is penetrated in a defined surface zone by an air stream. There the individual fibers accumulate on the remote portion of the rectilinear boundry area—as seen in direction of movement of the surface—of the air stream and are twisted together into a yarn. Technically this principle is preferably realized by supplying the individual fibers to a rotating roller with an air permeable cylindrical surface. In the interior of the roller there is an air suction system whose axially parallel orifice lies close to the inner circumference of the roller.

The disadvantage of this process and of this arrangement lies in the high consumption of air which is required in order to assure a stable operation and in order to provide the requisite torque for the twisting of the fiber body. Moreover, there occur considerable unevennesses of the yarn, which are presumably due to unevennesses of the fiber feed.

It is further known from British Pat. No. 936,628 to dispose the fiber feed channel so closely to the orifice area of the air suction arrangement that a vacuum arises in the fiber channel. This measure is in practice not feasible, because it allows for only very small distances between the mouth of the fiber channel and the moved surface. The gap between the moving surface, e.g., the air permeable cylindrical surface, and the fiber feed channel clogs. Therefore, it is difficult to draw off the yarn.

The purpose of this invention is to further develop the spinning apparatus of the aforesaid type in such a way that there occurs a substantially lower air consumption, without impairment to the stability of operation.

The process of the invention permits several forms of execution. In a first form of execution, the spinning unit consisting of one or more air-permeable rotating drums is housed in a subpressure chamber. According to another form of execution of the process of the invention, the carding unit in which the fiber tow supplied to the spinning device is disentangled into individual fibers and which is connected by a flow channel with the spinning unit, is surrounded by an excess pressure chamber. In the excess pressure chamber there is generated an excess pressure $P_{ii}$ of 200 to 1,000 mm water column (pressure in mm of water height), preferably 200–600 mm Ws (water column).

A third procedure according to the invention is characterized in that in correspondence to the first form of execution the spinning unit is housed in a subpressure chamber and in that, furthermore—in correspondence to the second form—the carding unit is surrounded by an air-pressurizable chamber. It has proved that, by the invention, there can be achieved a substantial improvement in quality of the yarn generated in the known spinning devices operating with a single roller or two rollers.

The practice of the invention with two rollers and two airstreams provided by suction means for each roller, as described later in detail, assures local air flow control relative to the yarn formation line. Through this air flow control is achieved a defined working zone—i.e., a defined yarn formation line—formed between the rollers. This is especially important for the generation of high-quality yarns. If the disclosed arrangement of the air entry openings of the suction devices is not maintained, two yarns may be simultaneously formed on two lines of yarn formation, leading further to unsatisfactory yarn strengths. The use of the hyperboloids of rotation as the configuration of the roller surfaces permits a simultaneous spinning and axial conveyance of the generated yarn.

The invention herein allows a considerable lowering of the air consumption. This holds even in the instances in which, in the fiber flow channel, injectors are installed which aid in release of the individual fibers from the carding roller and the conveyance of the individual fibers into the yarn formation zone. In particular, with injectors to inject air into the carding chamber which houses the carding roller, it is possible to reduce the air consumption of these injectors quite decisively and to bring about controlled air flow patterns from the fiber tow inlet of the carding device all the way to the yarn formation zone.

According to a preferred form of the invention, the injectors are arranged in the flow channel in such a way that a turbulent air flow arises between carding chamber and spinning device. This provides relatively even distribution of the fibers in the conveying air stream.

Especially good results in respect to yarn strength and thread uniformity can be achieved if the injectors in the flow channel are aligned in such a way that the air flow forms a spiral air turbulence which preferably has the same direction of rotation as that of the direction of twist of the fibers into the yarn.

Further, in the course of the execution of the process of the invention an improvement in yarn quality can be achieved by having the flow channel inclined toward the narrowest gap formed between the rollers of the fiber-spinning unit in such a way that the generated air flow has a movement component opposite to the withdrawal direction of movement of yarn from the gap.

In other apparatus embodiments of the invention, wherein the carding unit is contained in a pressurized chamber, the pressurized chamber on the one hand and the carding chamber on the other hand may be in communication with one another via the inlet passage for the fiber tow. Preferably, the carding chamber in which carding roller is accommodated has air passages from the pressurized casing, whereby a favorable influencing of the pressure gradient and of the air flow between the pressurized chamber and the carding chamber and the fiber feed can be attained.

The pressurized chamber may be sealed to minimize air flow to the atmosphere in the area of the inlet passage for the fiber tow by various means. The passage may have a pair of contacting rollers with roller surfaces which yield elastically to the fiber tow passing therebetween, the gap around each roller being further sealed by a sealing strip in contact with the roller surface. Such rollers have the advantage that the fiber tow is conveyed against the air pressure. Instead of rollers, the inlet passage for the fiber tow may be sealed by elastically deformable sealing strips which deform about the fiber tow.

Another means for sealing the tow inlet passage involves using a funnel or other tapered member to connect the tow inlet passage of the casing with the tow passage of the carding unit. The narrowest cross section of the funnel conforms substantially to the cross-section of the tow. It terminates immediately ahead of a feed roller in the carding device. The funnel's passage preferably has at least one pair of opposed surfaces (e.g., the surfaces of opposed ribs) forming one or more narrow spaces through which the tow passes in contact with the surfaces. The distance between the initial tow-gripping line on the feed roller and the pair of opposed members most remote from said feed roller preferably is less than the staple length of the fibers. Where the funnel's passage has two of said pairs of opposed surfaces, the narrow space of the pair closest to said feed roller preferably is wider than that of the other pair of opposed surfaces.

The latter features of the funnel serve the purpose of minimizing the possibility that the fiber tow would be torn by the air escaping from the fiber tow inlet passage. The opposed surfaces hold the fiber tow over a length that is more than the staple length of the individual fibers. Such special construction of the inlet funnel provides that the air pressure of the air escaping through the fiber tow inlet passage is first lowered at the first pair of surfaces to atmospheric pressure, so that the air then can escape without damaging the fibers in the incoming tow.

A particular advantage of the invention resides in the feature that, throughout the spinning operation from the inlet of the fiber tow into the carding apparatus up to the air suction devices, there is a cascade type graduation of the air pressure, which is controlled in all the process stages of the spinning process and in all the apparatus parts of the spinning apparatus into an air flow proper to its function at each stage or part. This improved air pressure and air flow control resolves the fibers into individual fibers and uniform distribution of the latter, which are fed to the yarn forming zone, e.g., to the gap formed between the rollers.

For the further functionally suitable alignment of the distribution of the air flow, the flow channel may be provided with air injectors having converging air jets, whose function it is to supplement the air flow patterns normally resulting from the pressure drop in the flow channel in such a way that the cloud of individual fibers released from the fiber tow is distributed far and uniformly over the flow channel.

For the uniform distribution of the individual fibers, injection into the airstream in the flow channel of air jets to create turbulence is desirable. It was determined by tests, that with formation of a turbulent air flow, preferably having a spiral air vortex pattern, in the direction of rotation of the yarn being formed, it is possible to achieve an especially good yarn strength and yarn uniformity.

The invention will be further understood and appreciated from the following illustrative embodiments of the invention, which are illustrated in the drawings.

Figure 1:
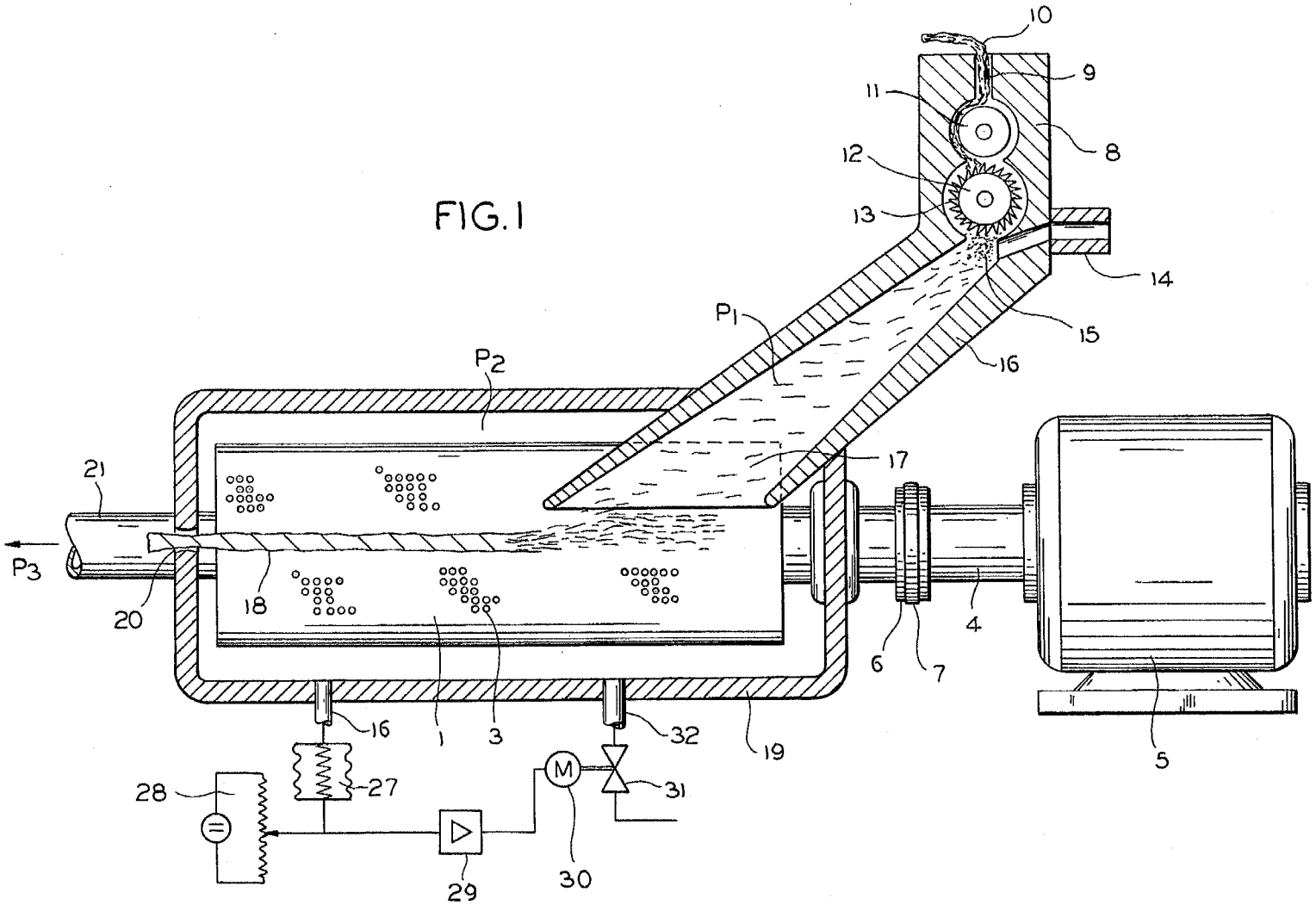
FIG. 1 is a longitudinal section view of a first embodiment of the fiber spinning apparatus taken on a section plane along the line of yarn formation in the gap between two rollers, one of which appears in FIG. 1.
Figure 2:
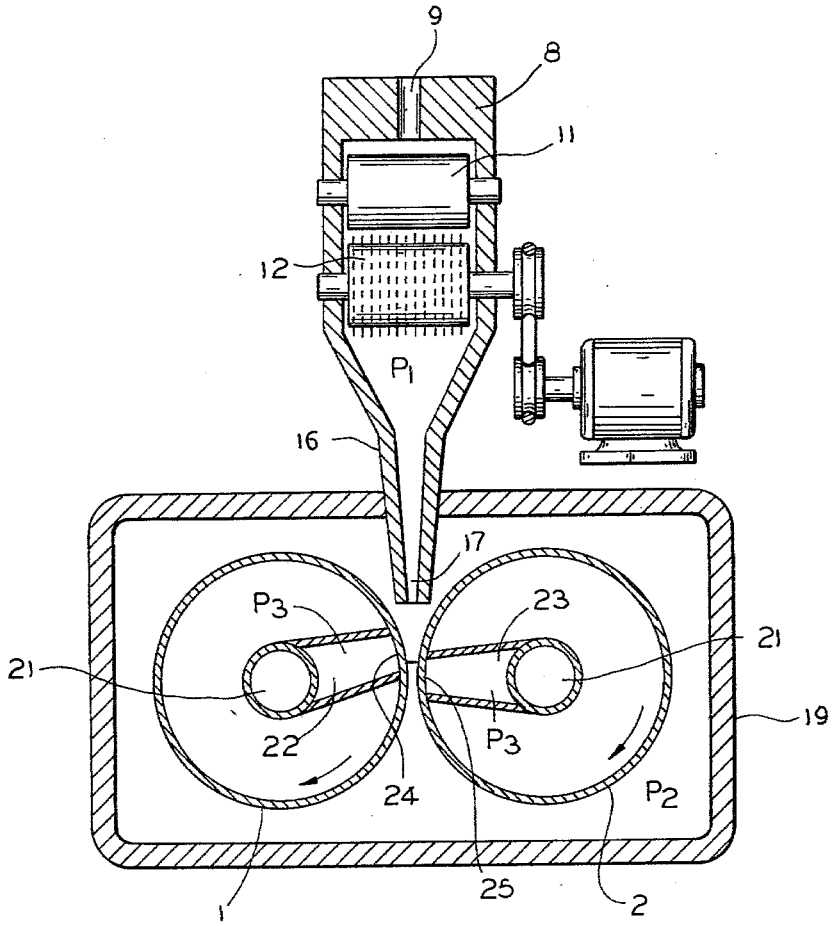
FIG. 2 is a transverse section view of the same embodiment.

The spinning apparatus illustrated in FIGS. 1 and 2 consists of the hollow rollers 1 and 2, the cylindrical walls have perforations 3 and are permeable to air. The rollers are supported on and driven by their shafts 4, belt pulley 6, drive belt 7 and the motor 5 in the same direction of rotation (FIG. 2). The fiber feed and carding unit 8 has an inlet passage 9 for the fiber tow 10, e.g., a band or ribbon of entangled fibers. The fiber tow 10 is drawn into the unit 8 by means of conveyor roller 11. The tow passes over the carding roller 12, on which it is resolved into individual fibers. The carding roller has on its circumference a plurality of sharp projections, by which the individual fibers are separated from the fiber tow. An air injector 14 adjacent the outlet of the cylindrical chamber for the carding roller further separates the fibers, and the individual fibers 15 are conveyed by the air stream into the flow channel 16. The fibers, initially oriented transversely to the line of yarn formation, are rotated parallel to the narrow mouth 17 of the channel. The fibers leave the mouth of the flow channel at as small as possible an angle to the yarn formation line and fly freely to the yarn producing zone in the gap between the rollers 1 and 2. There they are twisted by contact with the rollers 1 and 2 into a yarn 18 under action of the air streams drawn through the air permeable walls of the rollers. The air flows in respective rollers are generated by air suction devices, consisting of air suction ducts 21, 22 and 23, the latter two ducts 24 and 25 having rectangular air entry openings which lie close to the inner face of the air permeable wall of each of the rollers. Most or all of the area of each opening lies ahead of the narrowest gap formed between the rollers 1 and 2, as viewed in the direction of movement of its roller surface toward the gap. The orifice areas may overlap across the gap, a preferred overlapping range lying between 0 and 10 times the yarn diameter, i.e., a theoretical yarn diameter d, which is calculated according to the formula $$d = \frac{1.12838}{\sqrt{\gamma \times Nm}}$$

in this formula $\gamma$=the specific weight in g/cm$^3$

Nm=metrical number in meters per gram.

The overlap of the longitudinal edges of the openings is preferably 0 to 10 times the yarn diameter and ahead of the narrowest gap on the side thereof closest to the mouth of the flow channel. The orifices extend longitudinally over length which corresponds essentially to the length of the air-permeable portions of the rollers and parallel to the line of yarn formation. Reference is made to Dammann et al U.S. application Ser. No. 782,310, filed Mar. 28, 1977 now U.S. Pat. No. 4,130,983, for further description and details of the aforedescribed parts of the spinning apparatus.

It is also possible, however, to use the invention on spinning apparatuses which have only one air-permeable roller and an air suction unit disposed in it, as well as still other spinning apparatuses which have two rollers, but have other arrangements of the entry openings of the air suction systems. Especially good results, however, are achieved with use of two rollers with the arrangement of air entry openings as described above and in said Dammann et al application.

According to the invention the air-permeable roller or both of the air-permeable rollers 1 and 2 shown in the preferred embodiments are surrounded by a substantially airtight casing 19. The downstream end of the fiber feed channel 16 projects into the casing 19 through the casing wall, as do the two roller drive shafts 4, in substantially airtight fashion. Some airflow to or from the atmosphere, depending on the pressure maintained in the casing, occurs through the outlet opening 20 for the yarn produced within the casing.

Preferably a constant pressure $P_2$ is maintained in the casing 19. For this the air pressure from the tubular tap 26 is measured by means of measuring bellows 27. The measured pressure valve is converted by potentiometer 28 into an electric signal. The electric signal is amplified by amplifier 29 and the amplified signal is delivered to servo motor 30. The servo motor 30 operates a control valve 31 for the pressurized air or vacuum line 32 in such a way that the air pressure in the casing 19 remains substantially constant.

The apparatus of FIGS. 1 and 2 may be employed in the following process. Air is drawn through the air suction units 22,23, setting up constant pressure $P_3$ in the suction units. The valve 31 is now set by hand—or if pressure regulation is employed, by means of a desired value generator—at a certain pressure value $P_2$. In manual operation, this value $P_2$ may be measured from tap 26 by means of manometer or by means of the pressure bellows 27. The pressure $P_2$ prevails also between the mouth 17 of the channel 16 and the yarn formation line.

Similarly, the injectors used to inject pressurized air which ultimately reaches the channel 16, e.g., the air from injector 14, provide in a certain static pressure $P_1$ in the channel 16.

Air flows attuned to the optimum functioning of the spinning apparatus are achieved when the pressures described are so attuned that $P_3 < P_2 < P_1$.

A defined air flow pattern results, beginning with the carding chamber for the carding roller 13, or possibly with the injector 14 and extending through the permeable walls of the rollers 1 and 2 into the openings 24,25 of the suction devices 22,23. The slight and technically inconsequential leakages in the region of the shaft passages as well as of the yarn outlet opening 20 may be disregarded.

In constrast to the apparatus shown in British Patent 936,628 and the process described there, therefore, there is established not a pressure and flow connection between the fiber feed channel 9 and the suction means, but rather a pressure cascade from the fiber feed channel 16, through the region of the yarn formation line and into the suction arrangement. In particular, in conjunction with the apparatus of FIGS. 1 and 2, particularly the positions of the air entry openings of the suction means, the air flow currents around the forming yarn bring about a uniform feed of the individual fibers to the yarn formation line and thus contribute in an excellent manner to the uniformity and strength of the yarn.

This air flow pattern is attuned to the optimum functioning of the spinning apparatus, especially the fiber feed means and the fiber twisting means. It permits a substantial improvement of the spinning quality with reduction of the air consumption. It becomes possible to lower the air volume throughput of the injector 14 substantially, and, possibly, also to shut off the injector, depending on the level of the pressure $P_1$ desired and recognized as optimal. The pressure $P_1$ can be lower than the atmospheric air pressure, whereby it is assured that atmospheric air enters also through the inlet opening 9 for the fiber tow 10 and that defined air flow patterns arise, beginning at the inlet opening 9 and extending into the openings of the suction means.

The pressure $P_1$ in the flow channel may also be above atmospheric pressure, e.g., about 3 bar. Favorable values for the pressure $P_2$ between channel mouth 17 and the thread formation line are subpressures of 300 to 1000 mm water column (Ws). The pressure difference between this pressure $P_2$ and the pressure $P_3$ prevailing in the suction means within the rollers should amount to at least 1,000 mm water column. A favorable test value lay at 1,500 mm water column.

Figure 3:
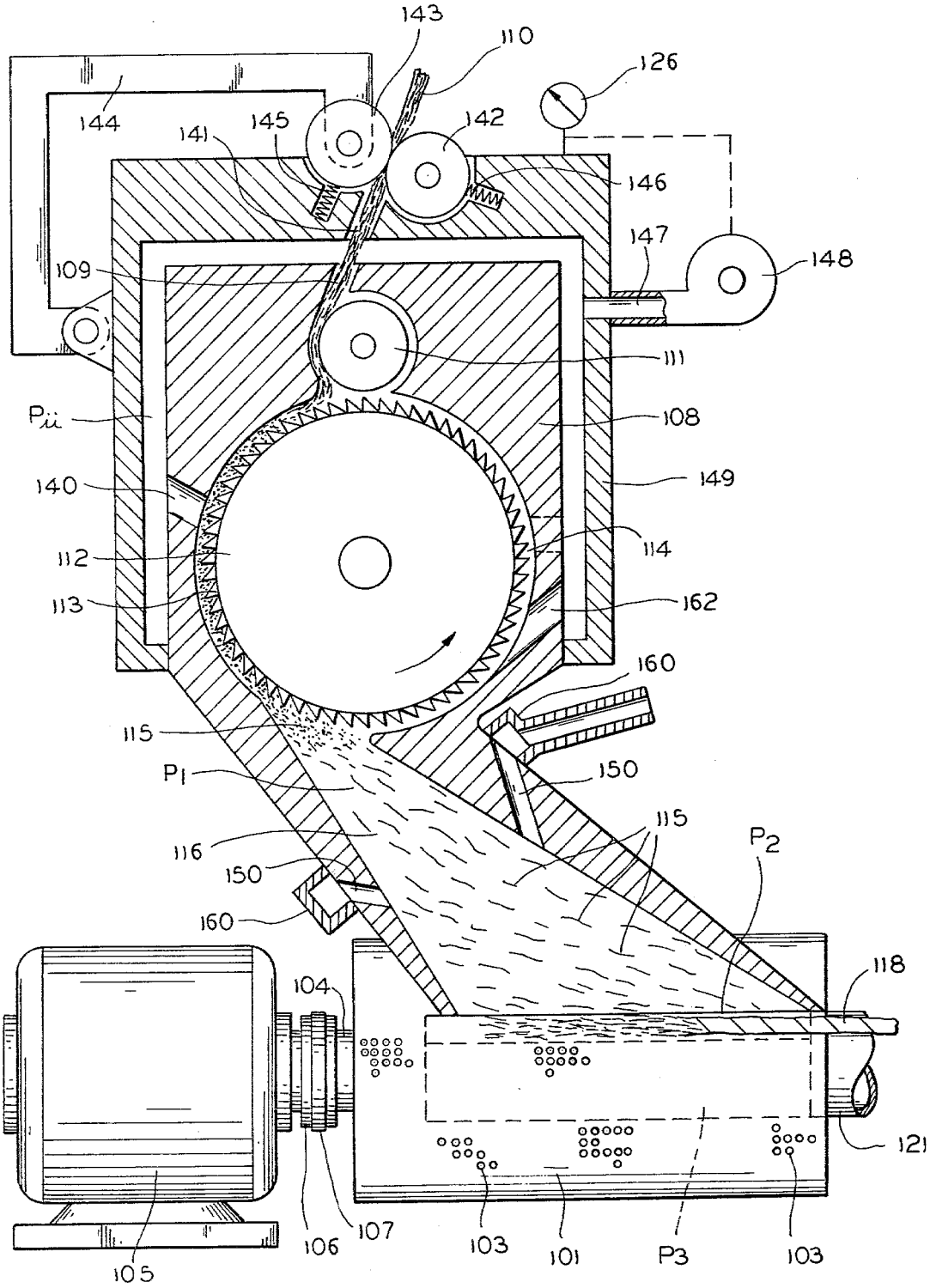
FIG. 3 is a longitudinal section view of a second embodiment taken on a section plane along the line of yarn formation in the gap between two rollers, as in FIG. 1.
Figure 4:
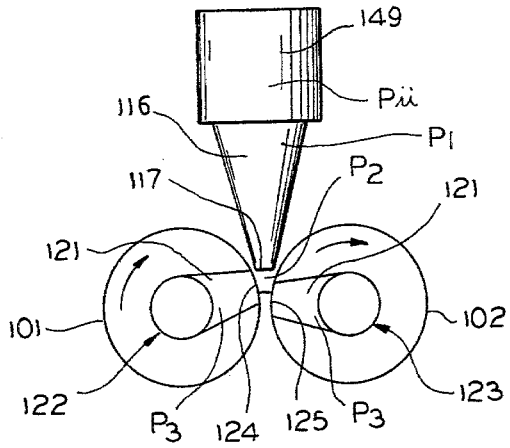
FIG. 4 is a schematic end elevation of the second embodiment.

The spinning apparatus of FIGS. 3 and 4 consists of the rollers 101 and 102, whose cylindrical walls are air permeable by virtue of perforations 103. The rollers are supported on one side by their drive shafts 104, which are driven by belt pulley 106, drive belt 107 and motor 105 in the same direction. They can advantageously be rollers whose air permeable roller surfaces are hyperboloids, which are longitudinally asymmetrical and have their smallest diameter at the yarn discharge end. The fiber feed unit 108 has a carding chamber 114 with an inlet passage 109 for the fiber tow 110. The fiber tow 110 is drawn in by means of conveyance roller 111 and by the carding roller 112, upon which it is resolved into individual fibers. The carding roller has on its circumference many sharp projections or teeth 113, by which the fiber tow is combed and individual fibers are separated from the fiber tow. By centrifugal and air flow forces, the individual fibers 115 are released from the roller and are conveyed into the flow channel 116. The flow channel shape and the air currents in the channel according to the invention cause the fibers to be aligned parallel to the channel mouth 117. The fibers leave the mouth of the channel in this manner at as small as possible an angle to the yarn formation line and fly freely to the yarn formation zone. By contact with the rollers 101 and 102 in the gap between the rollers and under action of the air currents generated by the suction means, the fibers are twisted into the yarn 118. The air currents passing into both rollers are generated by air suction units 122 and 123 operating with subpressure $P_3$ in the air suction connecting ducts 121 in the zone of the air entry openings 124 and 125, which lie close to the inner face of the rollers' air permeable, cylindrical walls. The air entry openings preferably correspond in shape and arrangement to the above description of openings 24 and 25, in FIGS. 1 and 2, i.e., with overlapping longitudinal edge portions having overlaps of 0 to 10 times the diameter of the yarn.

The overlapping zone is preferably 0 to 10 times the yarn diameter ahead of the narrowest gap on the side of said gap closest to the mouth of the channel. The openings extend over a length which corresponds essentially to the length of the air-permeable portion of the rollers, and are parallel to the yarn formation line.

It is possible to achieve also an improvement of spinning apparatuses using the improvements shown in FIGS. 3 and 4 with apparatus having only one air-permeable roller and one air suction arrangement disposed therein, as well as spinning apparatuses which have two rollers, but another arrangement of the air entry openings of the air suction means. Especially good results are achieved however, particularly with use of two rollers with the illustrated arrangement of the air entry openings. An especially reliable operation and good product are achieved with use of rollers with hyperbolic longitudinal curvature, which rollers are longitudinally asymmetrical and in which the fibers and yarn run in the direction from the larger end to the smaller end of the opposed hyperbolic surfaces of said rollers.

In FIGS. 3 and 4, the carding unit 108 is surrounded by an airtight, pressurizable casing 149. The walls of this casing are penetrated only by the fiber feed channel 116, the shafts of the carding and conveyance rollers 112 and 111, respectively, as well as the two inlet passage 141, the pressurized air feed line 147 and a measuring gauge 126.

In the casing 149 there is maintained a preferably constant pressure $P_u$, for which a regulation of the air pressure can take place by a measuring gauge 126 and compressed air generator 148 operated manually or automatically. Between the casing 149 and the chamber 14 of the carding roller 112 there is a connecting air passage 140 and further air passages, for example passage 162, provided according to expediency. Passage 162 serves especially for generating in the chamber of the carding roller an air stream directed against the running direction of the roller, thereby releasing fibers from the roller and balancing the air flow in the flow chamber 116.

The casing 149 is sealed off in the zone of the tow inlet opening 141 by the rollers 142 and 143. The roller 142 is journalled in fixed position in the casing 149 and driven at a constant speed adapted to the conveyance speed of the fiber tow 110. The roller 143 is journalled to turn freely on the swinging arm 144 and is pressed against the roller 142. Both rollers are made of an elastic soft material so that they conform upon deformation closely to the cross-section of the fiber tow 110. Both rollers are sealed by resiliently supported sealing strips 145 and 146 against air leakage past the rollers.

The apparatus described provides for practice of the following process.

By means of compressed air generator 148, a constant air pressure $P_{ii}$ in the casing 149 occurs at the fiber inlet opening 109 and the connecting passage 140 as well as possible further passages such as 162, and thereby also in the carding chamber 114. In consequence of the pressure gradient occurring in the flow channel 116 ($P_u > P_1 > P_2$) a defined air flow through the channel 116 results. This air flow leads to the result that the individual fibers are flung from the carding roller as free-flying cloud of fibers, which are parallelized, aligned, straightened, and also conveyed at a high speed to the yarn formation line 118. In the zone of the thread formation line 118 atmospheric pressure $P_2 = P_o$ prevails. In the region of the narrowest gap between the rollers 101 and 102 the individual fibers are collected in front of the air entry openings 124 and 125 of the suction units 122 and 123 and are twisted together into a yarn. In the air suction units 122 and 123, there prevails a subpressure $P_3$ which is lower than atmospheric pressure $P_0$.

The air pressures $P_u$, $P_1$, $P_2$ and $P_3$, therefore, are graduated in cascade form and adapted to the individual process steps of the twisting process. The pressure $P_1$ drops from $P_{ii}$ toward $P_o$ but remains higher than atmospheric air pressure $P_o$ while the air pressure $P_3$ arising in the suction units is always less than the atmospheric air pressure. Suitable values for the pressure $P_{ii}$ lie at 200 to 1000 mm water column gauge pressure with the most favorable values in the lower range. Favorable values for the pressure $P_3$ lie at 1000 to 2500 mm water column subpressure.

Figure 5:
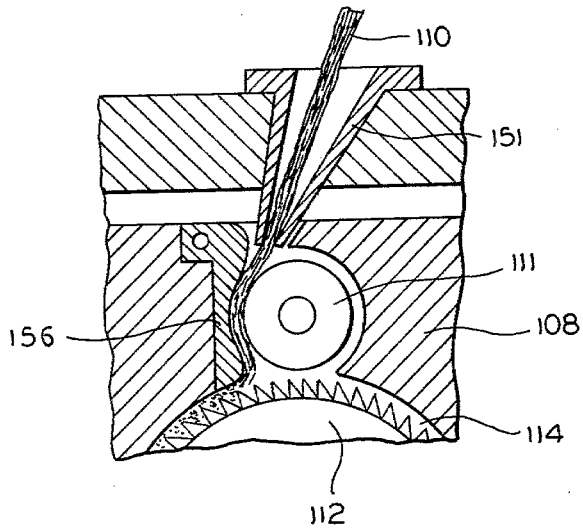
FIG. 5 is a fragmentary, section view of an embodiment of the fiber tow feed portion of a fiber carding device used in FIGS. 1–3.

In FIG. 5 there is shown a further preferred embodiment for the sealing off of the fiber tow inlet channel in the pressurized casing 149. The sealing element is tapered like a funnel 151. The narrowest cross section is substantially that of the fiber tow cross section. For this reason the funnel is exchangable for another of different dimensions. The funnel extends to a point immediately ahead of the conveyance roller 111. Through this simple measure pressure losses in the region of the fiber tow inlet are almost completely avoided, and the easy introduction of the fiber tow up to the conveyance roller 111 is assured.

Figure 6:
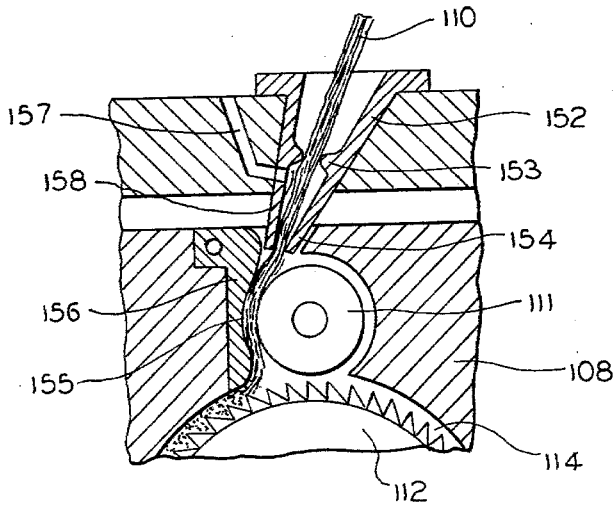
FIG. 6 is a view similar to FIG. 5 of another embodiment of the fiber tow feed portion of the carding device illustrated in FIGS. 1–3.

In FIG. 6 there is shown a special form of the funnel serving as the sealing element. The funnel has two narrow gaps or spaces 153 and 154. The distance of the gap 153 to the contact point 155 between the entry conveyor roller 111 and the counterpressure plate 156 is less than the staple length of the fibers. Between the two gaps or spaces 153 and 154 there is an air passage 157, which connects with the funnel channel and the atmosphere. The passage 157 in particular connects an annular groove 158 formed between the gaps or spaces 153 and 154 with the atmosphere. Through this design of the funnel, the air escaping as leakage through the funnel channel can expand without destroying the fiber tow being drawn in by the entry roller 111.

The injector passages 150 shown in FIG. 3 have special features. The injector passages 150 are situated in pairs, one in each of the upper and lower boundary walls of the flow channel. Each pair of injector passages 150 is arranged in such a way that their axes converge at an acute angle to the direction of air flow through the channel. The air flow forming in consequence of the pressure build-up in the flow channel 116 is guided in a desired manner. The arrangement of the passages 150 in respect to their position in the flow channel and their outlet direction must be established in a test so that the individual fibers 115 are distributed as uniformly as possible in the channel. It has proved that by locating the exit openings of the injectors in the second third of the length of the flow channel there can be achieved especially advantageous effects. Pressurized air is supplied through manifold 160 to the passages 150.

Figure 9:
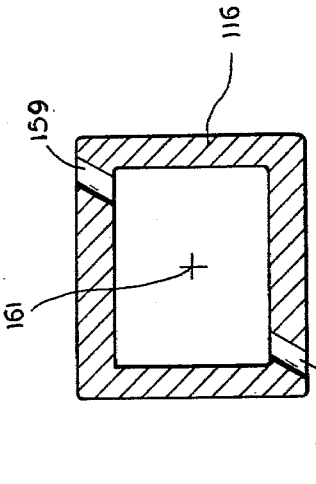
FIG. 9 is a transverse section view of a fiber feed channel and illustrates air jet orifices which induce a spiral air flow pattern in the channel.

As shown in FIG. 9, the injector passages 159 and 160 are arranged in such a way that, on the one hand, they generate a movement component of the air in the direction of the mouth 117 of the flow channel 116, as is also the case in FIG. 3 for the passages 150. On the other hand, the injector passages 159 and 160 are angled toward mid-point 161 of the flow channel in such a way that a turbulent air vortex arises. It has proved that with this arrangement of the injectors it is possible to achieve a uniform density of the fiber cloud and a substantial improvement of the yarn quality.

Figure 7:
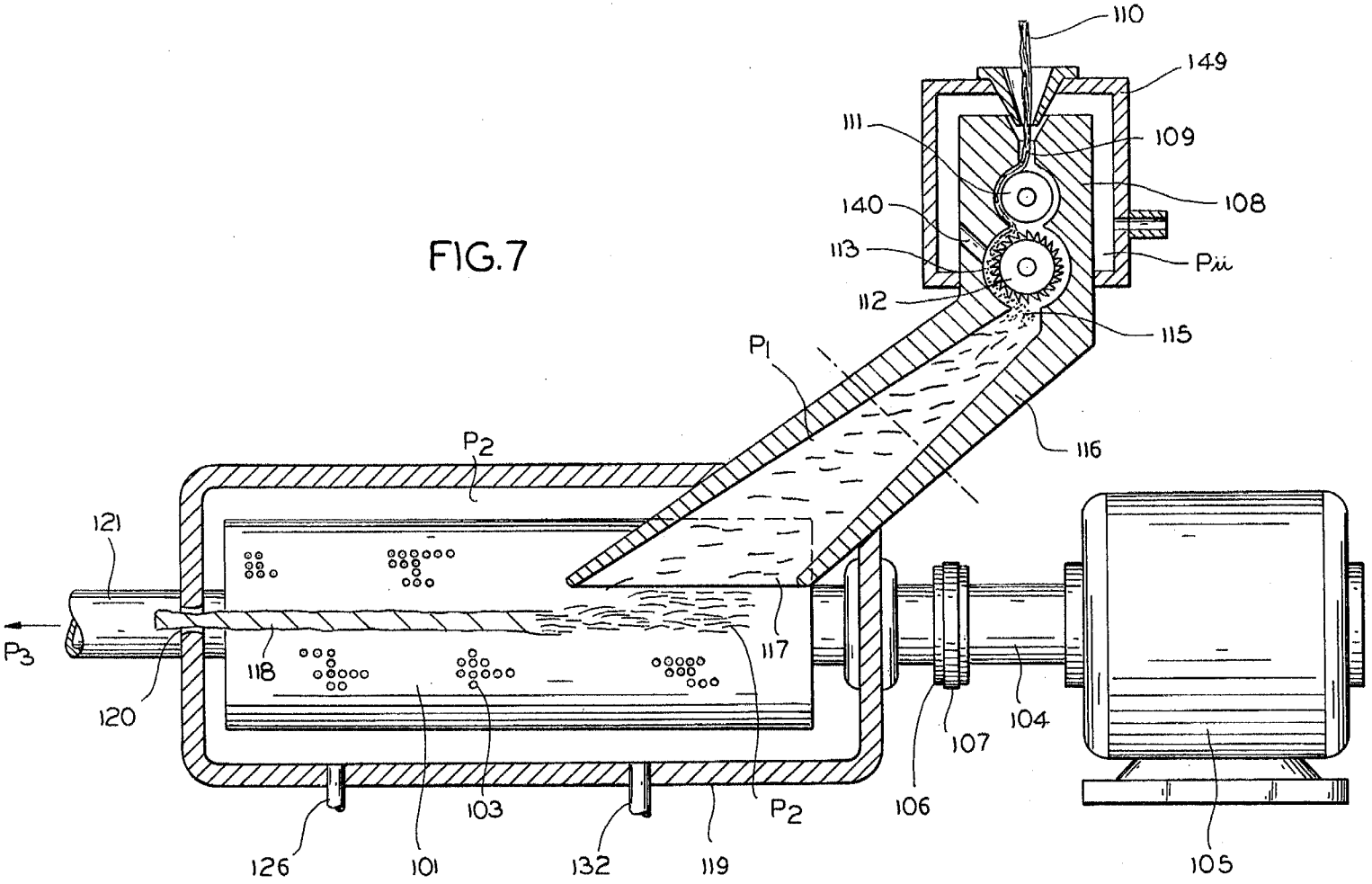
FIG. 7 is a longitudinal section view on a section plane like that of FIG. 1. and illustrates a third embodiment of the fiber spinning apparatus.

In the embodiment of FIG. 7, fiber carding unit 108 is surrounded by a pressurizable chamber 149, while the twisting unit, i.e., the rollers 101 and 102 are housed in a subpressure casing 119. In connection with the further details reference is made to the description for FIGS. 1 and 3. The flow channel 116 issues in the gap between the rollers as shown in FIG. 2. A constant subpressure, for which, if need by, there may be used the measuring tap 126, is maintained by a vacuum drawn through tube 132. In the rollers there are mouths (not visible) of the air suction units 122 and 123, which are connected to the air suction conduit 121. The yarn 118 leaves the subpressure casing 119 through the outlet opening 120 in an end wall of the casing. The opposite end wall may have an opening to admit a core yarn or filament about which the fibers are twisted.

In this embodiment there are the following pressure relationships:

$$P_2 < P_0 < P_{ü} > P_1 > P_2 > P_3.$$

In comparative tests there was generated on an apparatus like that of FIG. 7 a yarn Nm 40 of Diolene 12 (trademark of the firm, ENKA) made of polyethylene terephthalate staple fibers of 40 mm. Values attained are found in the appended table.

| $P_3$ (mm Ws) | $P_2$ (mm Ws) | $P_1$ (mm Ws) | $P_{ü}$ (mm Ws) | Strength (Rkm) | ester Value U (%) | Flow control through injector |
|---|---|---|---|---|---|---|
| $P_0$ | $P_0$ | $P_0 < P_1 < 600$ | 600 | No thread | | |
| − 2300 | $P_0$ | $P_0$ | $P_0$ | 11,8 | 18,9 | Yes |
| − 1500 | $P_0$ | $P_0 < P_1 < 400$ | 400 | 17,9 | 20,4 | No |
| − 1500 | $P_0$ | $P_0 < P_1 < 400$ | 400 | 19,7 | 12,5 | Yes |
| − 2500 | − 1500 | $P_2 < P_1 < 400$ | 400 | 19,9 | 11,8 | Yes |

Figure 8:
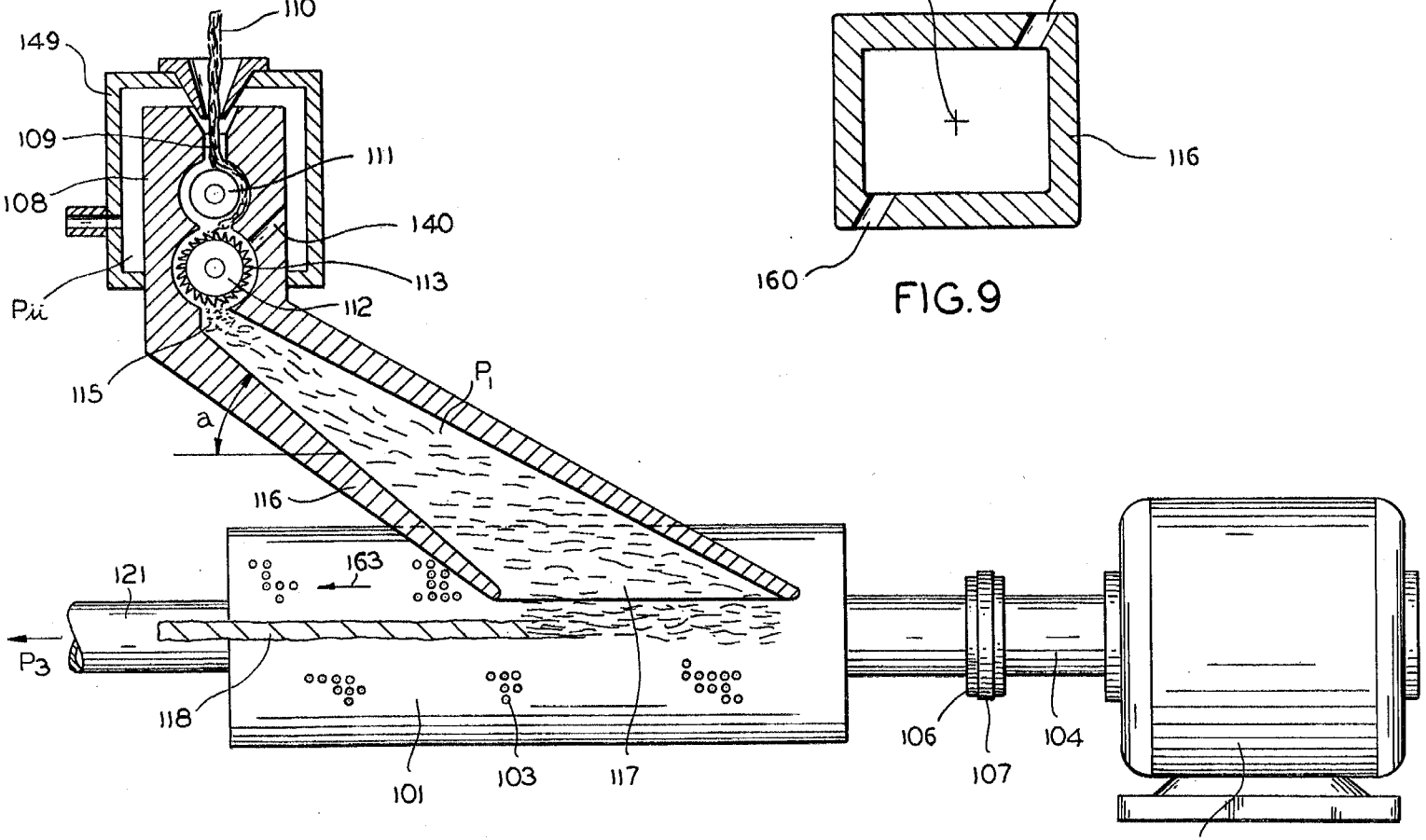
FIG. 8 is a longitudinal section view on the same type of section plane of a fourth embodiment, which resembles the third embodiment except as to direction of the fiber feed channel.

The embodiment of FIG. 8 corresponds essentially to the embodiment of FIG. 3. Reference can be made in this connection to FIG. 3 for the parts and their function. The pecularity of the embodiment of FIG. 8 is that the flow channel is inclined (slopes) with respect to the yarn formation line 118 or the channel mouth 117 at an angle $\alpha$ such that the fibers flying onto the yarn formation line have a vector component of movement which is opposite to the yarn draw-off direction. Arrow 163 shows the yarn draw-off direction. From this arrangement of the channel there can be achieved a substantial uniformity of the yarn produced. The angle $\alpha$ should be as small there as possible and is preferably below 45°.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. In a process for spinning fibers into a yarn by the steps of introducing a tow of fibers into a carding chamber having a rotating carding roller and discharging individual, separated fibers into a fiber feed channel, conveying the fibers in an airstream flowing through said channel and out of an elongated, narrow mouth of said channel extending parallel with and contiguous to a line of yarn formation in which said fibers are spun into a yarn on at least one air permeable surface moving substantially transversely to the line of yarn formation and through which air is drawn along the line of yarn formation by suction means, the improvement wherein an air pressure gradient is maintained so that the static air pressure decreases in cascade fashion such that $$P_{ü} > P_1 > P_2 > P_3 < P_0,$$

wherein $P_{ü}$ is a superatmospheric pressure in the carding chamber, $P_1$ is the air pressure in the channel, $P_2$ is the air pressure in the free flight interval of the individual fibers between the mouth of the channel and the line of yarn formation, $P_2$ being equal to or less than $P_0$, $P_3$ is the air pressure in the suction means, and $P_0$ is the atmospheric air pressure.

2. A process according to claim 1, wherein $P_2$ is less than the atmospheric air pressure $P_0$.

3. A process according to claim 2, wherein $P_1$ is less than the atmospheric air pressure $P_0$.

4. A process according to claim 2, wherein said mouth is located in an enclosure in which the air pressure $P_2$ is regulated at a constant value less than said atmospheric pressure $P_0$.

5. A process as claimed in claim 2, wherein said fibers are fed to said channel from a fiber carding chamber in which a superatmospheric pressure $P_u$ is maintained, and the respective air pressures are maintained so that the air pressure $P_1$ in the channel is greater than $P_0$, the air pressure $P_3$ in the suction means is less than $P_0$, the air pressure $P_1$ in the channel is greater than $P_2$, the air pressure $P_2$ in the free flight interval of the individual fibers between the mouth of the flow channel and the yarn formation line is less than $P_0$, and that the air pressure $P_3$ in the suction means is less than $P_2$.

6. A process as claimed in claim 1, wherein said fibers are fed to said channel from a fiber-carding chamber in which a superatmospheric pressure $P_{ü}$ is maintained, and the respective air pressures are maintained so that the air pressure $P_1$ in the channel is greater than $P_0$, the air pressure $P_2$ in the free flight interval of the individual fibers between the mouth of the channel and the yarn formation line is equal to $P_0$, and the air pressure $P_3$ in the suction means is less than $P_0$.

7. In an apparatus for spinning of individual fibers into a yarn along a line of yarn formation including hollow, air permeable, rotating roller means containing suction means into which a current of air is drawn to form said line of yarn formation extending longitudinally along the roller means, fiber feed channel means for conveying a stream of said fibers through a channel mouth extending along and adjacent to said line of yarn formation, the improvement comprising carding means to receive a tow of fibers and separate it into the individual fibers, said carding means embodying a rotatably driven carding roller with projections on its circumference in a carding chamber communicating with said channel for discharge of separated fibers into the channel, a pressurizable casing forming a substantially airtight chamber about said carding means, tow passage means extending through said casing for feed of a tow of entangled fibers to said carding means, seal means to seal the tow passage means substantially against leakage of pressurized air, and air passage means in said carding means for flow of pressurized air from said casing through said carding means into said channel.

8. Apparatus as claimed in claim 7, wherein said seal means embodies a pair of contacting rollers between which said tow passes.

9. Apparatus as claimed in claim 8, and a sealing strip pressed against each roller to prevent air loss from the pressurized chamber past said rollers to the atmosphere.

10. Apparatus as claimed in claim 8, wherein the contacting roller surfaces comprise an elastic material which yields to the tow passing between said surfaces.

11. Apparatus as claimed in claim 7, wherein said seal means embodies strips in the tow passage which yield elastically to the tow passing therebetween.

12. Apparatus as claimed in claim 7, wherein said seal means is a funnel member extending through said casing toward the tow passage of said carding means, the tow passage of said member having its smallest cross-section substantially conforming to the cross-section of the tow.

13. Apparatus as claimed in claim 12, said funnel member extending through the pressurizable chamber and terminating in the tow passage of the carding means immediately ahead of a feed roller operating in said carding means.

14. Apparatus as claimed in claim 13, wherein said funnel's passage has at least one pair of opposed surfaces forming a narrow space through which the tow passes in contact with said surfaces, the distance between said feed roller and the pair of opposed members most remote from said feed roller being greater than the staple length of said fibers.

15. Apparatus as claimed in claim 14, wherein said funnel's passage has two of said pairs of opposed surfaces, the narrow space of the pair closest to said feed roller being wider than that of the other pair.

16. Apparatus as claimed in claim 7, said carding roller being mounted in a carding chamber in said carding means such that the axis of the carding roller and said carding chamber is positioned at a right angle to the line of yarn formation.

17. Apparatus as claimed in claim 7, and means to maintain the respective air pressures in said apparatus in a relationship wherein the static pressure $P_1$ in said channel means is greater than the static pressure $P_2$ in the free interval of said fibers from the channel mouth to the line of yarn formation, the static pressure in said free flight interval is below atmospheric pressure $P_0$, and the static pressure $P_3$ in said suction means is less than $P_2$.

18. Apparatus as claimed in claim 7, and air injector means to inject air into said channel means in the direction of flow of said fibers through said channel means.

19. Apparatus as claimed in claim 18 wherein said air injector means comprises at least one pair of air passages extending through opposite sides of said channel means for injecting converging jets of air at respective acute angles to the direction of fiber flow through said channel means.

20. Apparatus as claimed in claim 19, wherein the exit openings of said pair of orifices are positioned in the second one-third of the length of said channel means.

21. Apparatus as claimed in claim 18, wherein said air injector means is oriented to generate turbulent air flow in said channel means.

22. Apparatus as claimed in claim 21, wherein said injector means embodies orifices oriented to induce spiral air turbulence in said channel means.

23. Apparatus as claimed in claim 22, wherein said orifices are oriented to provide a direction of rotation of the spiral air turbulence which is the same as the direction of rotation of the fibers in the line of yarn formation.

24. Apparatus as claimed in claim 7, wherein said channel means extends toward said line of yarn formation and is inclined relative thereto to provide air and fiber flow therethrough with a vector component of movement opposite to the draw off direction of movement of the spun yarn along the line of yarn formation.

25. Apparatus as claimed in claim 7, wherein the fiber spinning unit comprises a pair of rollers driven in the same direction of rotation with a small gap therebetween, the line of yarn formation developing in or adjacent to the narrowest gap, and the gap width being substantially the same as the diameter of the yarn produced, and at least one roller having said air permeable surface and suction means.

26. Apparatus as claimed in claim 25, wherein both rollers have air permeable surfaces, and each roller having air suction means with its air entry opening extending longitudinally adjacent the line of yarn formation.

27. Apparatus as claimed in claim 26, wherein each of said air entry openings is respectively positioned relative to the yarn forming zone between said rollers to draw substantially all of its current of air through the respective air permeable surface of its roller immediately preceding the yarn producing zone, as viewed in the direction of movement of its roller's surface at said yarn producing zone.

28. Apparatus as claimed in claim 27, wherein said air entry openings have longitudinal edge portions adjacent the yarn producing zone, said edge portions having relative positions ranging from no overlap up to an overlap with each other as viewed across the gap between said rollers by an overlap width of 0 to 10 times the diameter of the yarn produced.

29. Apparatus as claimed in claim 28, wherein the overlapping zone of said longitudinal edge portions is located a distance of 0 to 10 times the diameter of the yarn produced ahead of the narrowest gap width between said rollers and on the side of said gap closest to the mouth of said feed channel.

30. Apparatus as claimed in claim 25, wherein the roller surfaces are hyperboloids of rotation, thereby having a longitudinal hyperbolic concavity.

* * * * *